US009428904B2

(12) United States Patent
Barr et al.

(10) Patent No.: US 9,428,904 B2
(45) Date of Patent: Aug. 30, 2016

(54) MODULAR JOINT BARRIER RETAINER ASSEMBLY AND METHOD

(71) Applicants: Roger W. Barr, Williamsport, PA (US); Kevin W. Smith, Hughesville, PA (US)

(72) Inventors: Roger W. Barr, Williamsport, PA (US); Kevin W. Smith, Hughesville, PA (US)

(73) Assignee: EMEH, Inc., Lebanon, NJ (US)

( * ) Notice: Subject to any disclaimer, the term of this patent is extended or adjusted under 35 U.S.C. 154(b) by 0 days.

(21) Appl. No.: 14/474,632

(22) Filed: Sep. 2, 2014

(65) Prior Publication Data

US 2016/0060862 A1 Mar. 3, 2016

(51) Int. Cl.

| | |
|---|---|
| ***E04B 1/68*** | (2006.01) |
| ***E04B 1/74*** | (2006.01) |
| ***E04B 1/94*** | (2006.01) |

(52) U.S. Cl.

CPC ..... *E04B 1/6803* (2013.01); *E04B 1/68* (2013.01); *E04B 1/74* (2013.01); *E04B 1/948* (2013.01)

(58) Field of Classification Search

CPC ..... E04B 1/948; E04B 2/7411; E04B 2/7457
USPC ..... 52/396.01, 393, 716.1, 698
See application file for complete search history.

(56) References Cited

U.S. PATENT DOCUMENTS

| | | | | | |
|---|---|---|---|---|---|
| 3,057,117 | A | * | 10/1962 | Singer | 52/11 |
| 4,663,894 | A | * | 5/1987 | LaRoche et al. | 52/15 |
| 4,811,529 | A | * | 3/1989 | Harris et al. | 52/396.01 |
| 4,866,898 | A | * | 9/1989 | LaRoche et al. | 52/396.01 |
| 4,942,710 | A | * | 7/1990 | Rumsey | 52/396.01 |
| 5,461,838 | A | * | 10/1995 | Heller | 52/396.01 |
| 6,112,488 | A | * | 9/2000 | Olson et al. | 52/393 |
| 6,128,874 | A | * | 10/2000 | Olson | E04B 1/948 52/232 |
| 6,131,352 | A | * | 10/2000 | Barnes et al. | 52/396.01 |
| 8,464,485 | B2 | * | 6/2013 | Hilburn | 52/396.01 |
| 2010/0319287 | A1 | * | 12/2010 | Shaw | 52/396.01 |

* cited by examiner

*Primary Examiner* — Brent W Herring
(74) *Attorney, Agent, or Firm* — Clements Bernard PLLC; Lawrence A. Baratta, Jr.; Christopher L. Bernard

(57) ABSTRACT

A modular joint barrier retainer assembly, including: a barrier including one or more material layers; a retainer strip coupled to the barrier; and an anchor flange selectively coupled to the retainer strip at a first end of the anchor flange, wherein a second end of the anchor flange is configured to be selectively coupled to one or more of an expansion joint cover and a building substrate. The barrier is selectively disposed within an expansion joint or other gap of a building. The retainer strip is coupled to the barrier via one or more mechanical fasteners that are disposed through the one or more material layers and secured to the retainer strip. The anchor flange includes a hook portion that selectively engages a lip portion of the retainer strip. The anchor flange is selectively secured to the retainer strip via one or more mechanical fasteners.

15 Claims, 3 Drawing Sheets

MODULAR JOINT BARRIER RETAINER ASSEMBLY AND METHOD

FIELD OF THE INVENTION

The present invention relates generally to a modular joint barrier retainer assembly and method for anchoring a fire/smoke barrier, vapor/moisture barrier, sound barrier, insulation, or the like to a building substrate. More specifically, the present invention relates to a modular joint barrier retainer assembly and method that utilizes a retainer strip that is attached to the barrier and an anchor flange that attaches the barrier to the building substrate. This assembly may be used in conjunction with expansion and other joints or openings.

BACKGROUND OF THE INVENTION

Fire barriers, for example, are commonly used in expansion joints in buildings to provide the required fire protection, such that the "chimney effect" does not speed the proliferation of fire from one area to another. Typically, such fire barriers consist of a plurality of material layers backed by a metallic foil layer, fabric layer, or the like. The fire barriers are often "hung" in building expansion joints or other openings requiring the continuation of a fire rating from substrate to substrate. The fire barriers are installed either vertically or horizontally in a substantially U-like configuration, engaging the associated expansion joint covers and/or building substrates. Such installation can be made difficult by the wide variety of expansion joint/expansion joint cover sizes, shapes, and configurations, for example, making frequent fire barrier material splices and the like necessary, thereby increasing installation effort and reducing the effectiveness of the fire barriers in preventing the proliferation of fire from one area to another. Similar principles apply to vapor/moisture barriers, sound barriers, insulation, and the like.

Thus, what is needed in the art is a modular expansion joint barrier retainer assembly and method that essentially allows one configuration of barrier to be produced by a manufacturer that may be installed in a wide variety of expansion joints or other openings by selecting anchor flanges for the application, thereby making installation more simple and uniform, and reducing the number of splices and the like that are necessary, thereby maintaining the structural integrity of the fire/smoke barrier, vapor/moisture barrier, sound barrier, insulation, or the like.

BRIEF SUMMARY OF THE INVENTION

Accordingly, in various exemplary embodiments, the present invention provides a modular expansion joint barrier retainer assembly and method that utilizes a retainer strip that is attached to the barrier and an anchor flange that attaches the barrier to the building substrate.

In one exemplary embodiment, the present invention provides a modular barrier retainer assembly, including: a barrier including one or more material layers; a retainer strip coupled to the barrier; and an anchor flange selectively coupled to the retainer strip at a first end of the anchor flange, wherein a second end of the anchor flange is configured to be selectively coupled to one or more of an expansion joint cover and a building substrate. The barrier also may include a metallic foil layer, a high temperature fabric layer, and/or a scrim layer or the like coupled to the one or more material layers. The barrier is selectively disposed within an expansion joint or other gap of a building. The retainer strip includes a substantially vertical portion and a lip portion that is disposed at an angle to the substantially vertical portion. Optionally, the retainer strip, which may be continuous or consist of several short pieces, is coupled to a top portion of the barrier. Optionally, the retainer strip is coupled to the barrier via one or more mechanical fasteners that are disposed through the one or more material layers and secured to the retainer strip. Optionally, the anchor flange includes a substantially vertical portion that is coincident with the substantially vertical portion of the retainer strip, a substantially horizontal portion that traverses a top portion of the barrier, and one or more additional vertical and/or horizontal portions for selectively coupling the anchor flange to one or more of the expansion joint cover and the building substrate. The anchor flange also includes a hook portion that selectively engages the lip portion of the retainer strip. Optionally, the anchor flange is selectively secured to the retainer strip via one or more fasteners. Optionally, the anchor flange and the retainer strip are selectively secured to the one or more material layers via the one or more fasteners.

In another exemplary embodiment, the present invention provides a modular barrier retainer method, including: providing a barrier including one or more material layers; providing a retainer strip coupled to the barrier; selectively coupling an anchor flange to the retainer strip at a first end of the anchor flange; and selectively coupling a second end of the anchor flange to one or more of an expansion joint cover and a building substrate. The barrier also includes a metallic foil layer, a high temperature fabric layer, and/or a scrim layer coupled to the one or more material layers. The barrier is selectively disposed within an expansion joint or other gap of a building. The retainer strip includes a substantially vertical portion and a lip portion that is disposed at an angle to the substantially vertical portion. Optionally, the retainer strip, which may be continuous or consist of several short pieces, is coupled to a top portion of the barrier. Optionally, the retainer strip is coupled to the barrier via one or more mechanical fasteners that are disposed through the one or more material layers and secured to the retainer strip. Optionally, the anchor flange includes a substantially vertical portion that is coincident with the substantially vertical portion of the retainer strip, a substantially horizontal portion that traverses a top portion of the barrier, and one or more additional vertical and/or horizontal portions for selectively coupling the anchor flange to one or more of the expansion joint cover and the building substrate. The anchor flange also includes a hook portion that selectively engages the lip portion of the retainer strip. Optionally, the anchor flange is selectively secured to the retainer strip via one or more fasteners. Optionally, the anchor flange and the retainer strip are selectively secured to the one or more material layers via the one or more fasteners.

BRIEF DESCRIPTION OF THE DRAWINGS

The present invention is illustrated and described herein with reference to the various drawings, in which like reference numbers are used to denote like assembly components/method steps, as appropriate, and in which.

DETAILED DESCRIPTION OF THE INVENTION

Figure 1:
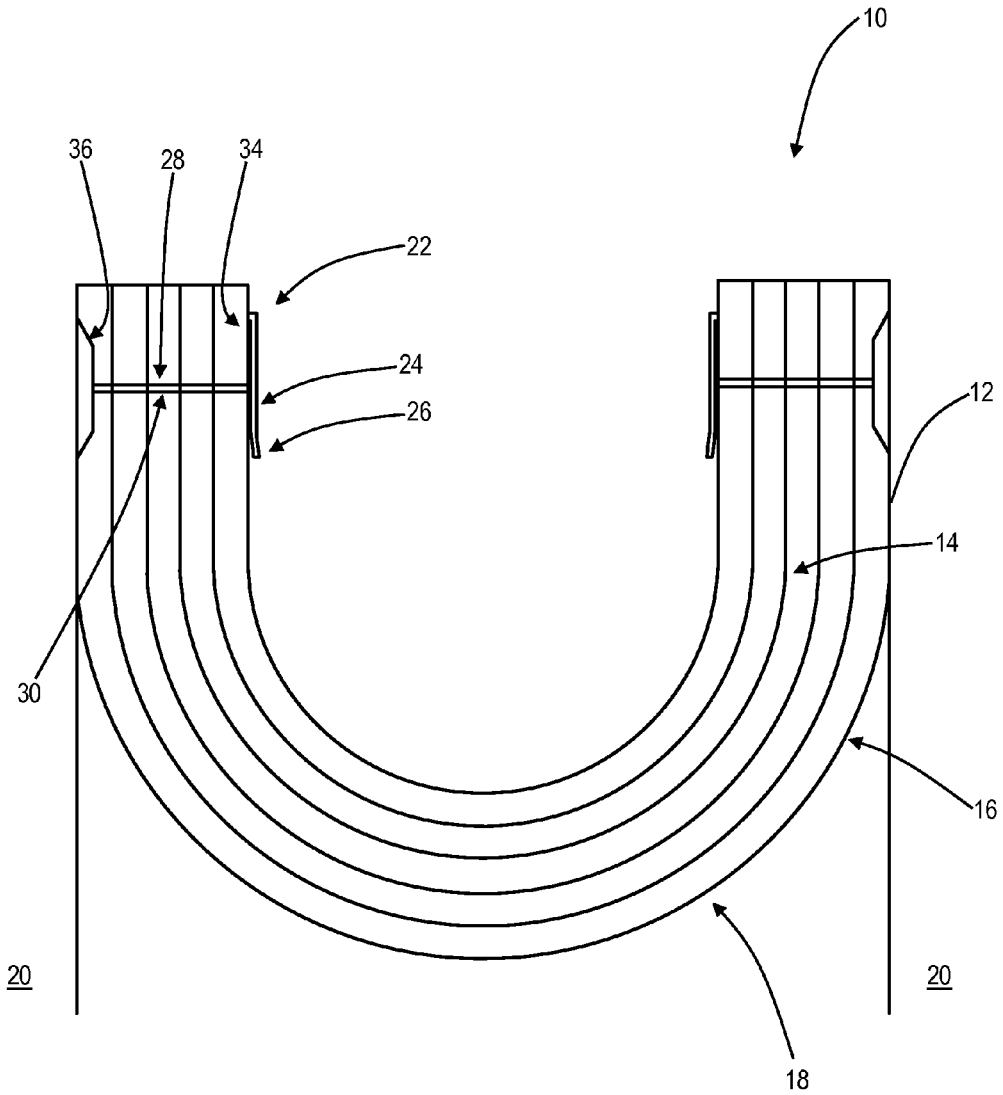
FIG. 1 is a schematic side view of one exemplary embodiment of the modular expansion joint fire barrier retainer assembly of the present invention, highlighting the retainer strip attached to the fire barrier.

Referring now specifically to FIG. 1, in one exemplary embodiment, the present invention provides a modular expansion joint fire barrier retainer assembly 10 that includes a conventional fire barrier 12 including one or more material layers 14. Optionally, the fire barrier 12 also includes a metallic foil layer, high temperature fabric layer, scrim layer, or the like 16 coupled to the exterior, intermediate, or interior surface(s) of the one or more material layers 14. The fire barrier 12 is selectively disposed within an expansion joint or other gap 18 of a building, between what is referred to herein as the building substrate 20. The fire barrier 12 is designed to fill and fireproof the expansion joint or other gap 18, carrying the fire resistance rating of the adjacent substrates across the opening between them. Accordingly, the one or more material layers 14 are made from ceramic fibers, fiberglass, mineral wool, intumescent materials, fabrics, metals, basalt, metal foam, synthetic fire resistant materials, or the like. Typically, the fire barrier 12 is a compliant structure that can be "folded" into or "hung" in the gap, requiring some attachment mechanism, including a friction fit, to secure it to the corresponding expansion joint cover and/or building substrate 20. It should also be noted that most of the components illustrated and described herein are elongate structures that typically run the length of the expansion joint 18 in question. Although the fire barrier 12 is generally described herein, it will be readily apparent to those of ordinary skill in the art that a smoke barrier, a vapor/moisture barrier, a sound barrier, insulation, or the like could readily be substituted for the fire barrier 12 without departing from the spirit or scope of the present invention.

A formed metal retainer strip 22 is coupled to the fire barrier (by the manufacturer, for example). In this exemplary embodiment, the retainer strip 22 includes a substantially vertical portion 24 and a lip portion 26 that is disposed at an angle to the substantially vertical portion 24. Preferably, the retainer strip 22 is coupled to the top lineal edge of the fire barrier 12 and is made from sheet metal, foil, expanded metal, fabric, or the like. The retainer strip 22 is coupled to the fire barrier 12 via one or more mechanical fasteners 28 that are disposed through the one or more material layers 14 and 16 and secured to the retainer strip 22 along its length. For example, each mechanical fastener 28 may include a metal pin 30 that is inserted through the one or more material layers 14 and 16 with a head, disc, or plate portion 34 and 36 disposed on either side of the one or more material layers 14 and 16, essentially forming a large rivet or the like that holds the one or more material layers 14 and 16 together and secures them to the retainer strip 22. In this exemplary embodiment, one retainer strip 22 is attached to each side of the fire barrier 12, and multiple retainer strips 22 can be used end-to-end on each side of the fire barrier 12. It will be readily apparent to those of ordinary skill in the art that other mechanisms may perform the same function and/or achieve a like result, and the use of all such equivalent mechanisms is contemplated herein.

Figure 2:
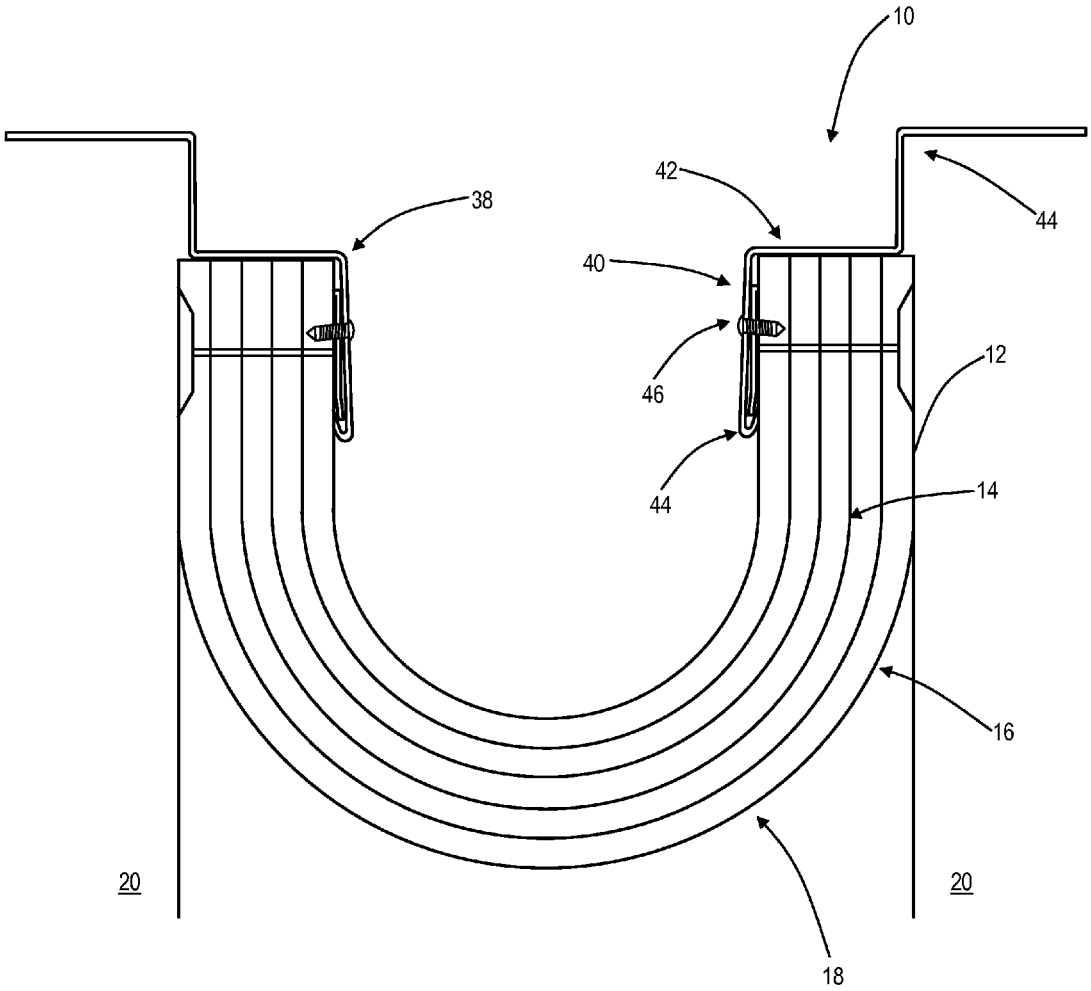
FIG. 2 is a schematic side view of one exemplary embodiment of the modular expansion joint fire barrier retainer assembly of the present invention, highlighting the retainer strip attached to the fire barrier and the anchor flange for attaching the retainer strip to the building substrate.
Figure 3:
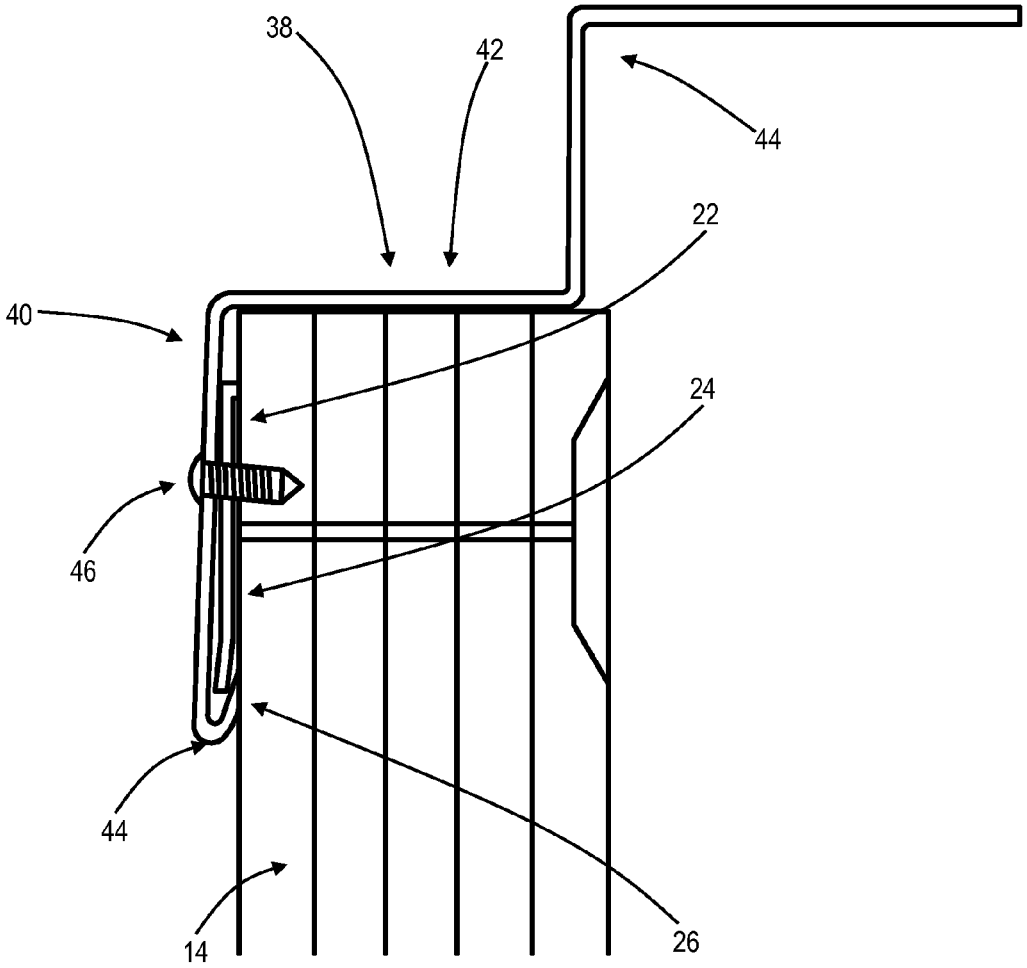
FIG. 3 is a partial schematic side view of the retainer strip attached to the fire barrier and the anchor flange for attaching the retainer strip to the building substrate as shown in FIGS. 1 and 2.

Referring now specifically to FIGS. 2 and 3, in one exemplary embodiment, the modular expansion joint fire barrier retainer assembly 10 also includes an anchor flange 38 that is selectively coupled to the retainer strip 22 at a first end of the anchor flange 38, wherein a second end of the anchor flange 38 is configured to be selectively coupled to one or more of the expansion joint cover and the building substrate 20, thereby securing the fire barrier 12 within the expansion joint or other gap 18. This coupling is performed in the field, for example and minimizes the number of splices that have to be made. This allows the fire barrier assembly and anchor flange(s) 38 to be produced in independent lengths, with each customized as needed. The anchor flange 38 includes, for example, a substantially vertical portion 40 that is coincident with the substantially vertical portion 24 of the retainer strip 22, a substantially horizontal portion 42 that traverses the top portion of the fire barrier 12, and one or more additional vertical and/or horizontal portions 44 for selectively coupling the anchor flange 38 to one or more of the expansion joint cover and the building substrate 20. It should be noted that the anchor flange 38 may include any suitable vertical, horizontal, or angled portions along its length such that the anchor flange 38, the retainer strip 22, and the fire barrier 12 can be secured within the expansion joint or other gap 18 of a building, and specifically to the floor, wall, ceiling, or other structure of the building. Importantly, the anchor flange 38 includes a hook portion 44 that selectively engages the lip portion 26 of the retainer strip 22. In this manner, the fire barrier 12 is essentially hung by the retainer strip 22 from the anchor flange 38, which establishes the proper position of the fire barrier 12 and supports its weight. The anchor flange 38 is selectively secured to the retainer strip 22 via one or more screws 46 or the like. Optionally, the anchor flange 38 and the retainer strip 22 are also selectively secured to the one or more material layers 14 via the one or more screws 46 or the like.

Although the present invention is illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. A modular barrier retainer method, comprising:

providing a barrier comprising one or more material layers with a retainer strip coupled thereto by a manufacturer, wherein first one or more mechanical fasteners coupled to the retainer strip extends through the one or more material layers, wherein the retainer strip is coupled to the barrier via the first one or more mechanical fasteners that are disposed through the one or more material layers and secured to the retainer strip by plates disposed on both sides of the barrier;

providing an anchor flange separate from the barrier with the retainer strip attached thereto, wherein the barrier with the retainer strip is produced separately and with independent lengths relative to the anchor flange;

selectively coupling, in the field, the anchor flange to the retainer strip and the barrier at a first end of the anchor flange where the retainer strip is coupled to the barrier, wherein the anchor flange is separately formed from the retainer strip, wherein the anchor flange is coupled to the retainer strip and the barrier via second one or more mechanical fasteners; and selectively coupling, in the field, a second end of the anchor flange to one or more of an expansion joint cover and a building substrate, wherein each of the barrier with the retainer strip and the anchor flange are customized based on the one or more of the expansion joint cover and the building substrate, and wherein the retainer strip is coupled to the one or more material layers separately from the selectively coupling of the anchor flange to the retainer strip and the building substrate, wherein the second one or more mechanical fasteners are coupled through the anchor flange, the retainer strip, and the one or more material layers at or near the first one or more mechanical fasteners.

2. The modular barrier retainer method of claim 1, wherein the barrier further comprises one of a metallic foil layer, a high temperature fabric layer, and/or a scrim layer in the one or more material layers, and the one of the metallic foil layer, the high temperature fabric layer, and the scrim layer is directly in contact with the building substrate.

3. The modular barrier retainer method of claim 1, further comprising selectively disposing the barrier within an expansion joint or gap of a building.

4. The modular barrier retainer method of claim 1, wherein the retainer strip comprises a substantially vertical portion and a lip portion that is disposed at an angle to the substantially vertical portion.

5. The modular barrier retainer method of claim 4, wherein the anchor flange comprises a substantially vertical portion that is coincident with the substantially vertical portion of the retainer strip, a substantially horizontal portion that traverses a top portion of the barrier, and one or more additional vertical and/or horizontal portions for selectively coupling the anchor flange to one or more of the expansion joint cover and the building substrate.

6. The modular barrier retainer method of claim 1, wherein the retainer strip is coupled to a top portion of the barrier.

7. The modular barrier retainer method of claim 1, wherein the anchor flange is selectively secured to the retainer strip via one or more fasteners.

8. The modular barrier retainer method of claim 1, wherein the anchor flange comprises vertical, horizontal, and angled portions along its length which are secured to both the barrier with the retainer and the one or more of the expansion joint cover and the building substrate, to support the barrier with the retainer.

9. The modular barrier retainer method of claim 8, wherein the vertical, horizontal, and angled portion are coupled to a floor, a wall, a ceiling, or another structure of a building to support the barrier with the retainer strip.

10. The modular barrier retainer method of claim 1, wherein the one or more mechanical fasteners are not coupled to the anchor flange or the building substrate, and wherein the barrier is separately coupled to the building substrate from the one or more mechanical fasteners via the anchor flange.

11. The modular barrier retainer method of claim 1, wherein the retainer strip holds the one or more layers together and, separately, the anchor flange supports the barrier via the building substrate.

12. A modular expansion joint barrier retainer method, comprising:

obtaining a barrier comprising one or more material layers held together by a retainer strip coupled through each of the one or more material layers by first one or more mechanical fasteners, wherein the retainer strip is coupled to the barrier via the first one or more mechanical fasteners that are disposed through the one or more material layers and secured to the retainer strip by plates disposed on both sides of the barrier;

obtaining an anchor flange which is separately formed from the barrier and the retainer strip, wherein the anchor flange comprises vertical, horizontal, and angled portions, wherein the barrier with the retainer strip is produced separately and with independent lengths relative to the anchor flange;

coupling, in the field, the anchor flange to the barrier at the retainer strip via second one or more mechanical fasteners, wherein the second one or more mechanical fasteners are coupled through the anchor flange, the retainer strip, and the one or more material layers at or near the first one or more mechanical fasteners; and coupling, in the field, one or more of the vertical, horizontal, and angled portions to one or more of an expansion joint cover and a building substrate, wherein each of the barrier with the retainer strip and the anchor flange are customized based on the one or more of the expansion joint cover and the building substrate, wherein the retainer strip is coupled to the one or more material layers separately from the coupling of the anchor flange to the retainer strip and the building substrate.

13. The modular expansion joint barrier retainer method of claim 12, wherein the barrier further comprises one of a metallic foil layer, a high temperature fabric layer, and a scrim layer in the one or more material layers, and the one of the metallic foil layer, the high temperature fabric layer, and the scrim layer is directly in contact with the building substrate.

14. The modular expansion joint barrier retainer method of claim 12, wherein the one or more mechanical fasteners are not coupled to the anchor flange or the building substrate, and wherein the barrier is separately coupled to the building substrate from the one or more mechanical fasteners via the anchor flange.

15. The modular expansion joint barrier retainer method of claim 12, wherein the retainer strip holds the one or more layers together and, separately, the anchor flange supports the barrier via the building substrate.

* * * * *